United States Patent [19]

Strobl et al.

[11] Patent Number: 4,553,289

[45] Date of Patent: Nov. 19, 1985

[54] APPARATUS FOR PRODUCING A WIDE FIBROUS WEB

[76] Inventors: Otto Strobl, Birkenhof 23, D-2820 Bremen 70; Harry Blien, Pfortmüller Str. 58, D-6718 Grünstadt; Wolfgang Uliczka, Landwehrstr. 36, D-2822 Schwanewede, all of Fed. Rep. of Germany

[21] Appl. No.: 553,248

[22] Filed: Nov. 18, 1983

[30] Foreign Application Priority Data

Nov. 18, 1982 [DE] Fed. Rep. of Germany ..... 3242539

[51] Int. Cl.[4] ..... D04H 11/04

[52] U.S. Cl. ..... 19/161.1; 19/163; 19/296

[58] Field of Search ..... 19/161.1, 163, 296

[56] References Cited

U.S. PATENT DOCUMENTS 1,953,457 4/1934 Baer ..... 19/161.1 X 3,713,933 1/1973 Sokolowski ..... 19/296 X

*Primary Examiner*—Louis K. Rimrodt

*Attorney, Agent, or Firm*—Hill, Van Santen, Steadman & Simpson

[57] ABSTRACT

Apparatus for producing a web whose width exceeds the working width of a machine having a number of take-off units and a table for conveying the web, for the production of webs from fibrous material, more particularly cards, carding machines, or pneumatic non-woven formers, the device having deflectors (12) which are associated one each with the take-off units (10) and which, as considered in the operative direction of the machine, are spaced apart from one another by a distance corresponding to the width of the taken-off web, the deflectors (12) extending at an angle to the operative direction of the machine, such angle corresponding to half the angle between the operative direction of the take-off table (10) and that of the table (14) for conveying the textile, and a corresponding method.

7 Claims, 4 Drawing Figures

APPARATUS FOR PRODUCING A WIDE FIBROUS WEB

The invention relates to apparatus for producing a fibrous web whose width exceeds the working width of a machine having a number of take-off units and a table for conveying the web, for the production of fibrous webs, more particularly cards, carding machines or pneumatic web formers, and to a corresponding method.

The width of the webs produced by the corresponding machines, such as cards or carding machines, is limited by the working width thereof. It is often required to produce webs of greater width than the working width of the particular machine used.

This problem has conventionally been solved by means of web lappers which so lap in a cross-wise pattern the webs removed transversely of the operative direction that the width of the removed web is the result of the lapping width of this cross-lapper. However, a number of webs must be superimposed in this procedure, with a resulting increase in the density of the finished web.

However, cross-lappers of this kind are capable only of reduced speeds of lapping, more particularly if the web taken off the machine is of reduced weight, since the air resistance encountered as the cross-lapper reciprocates slows down the lapping process.

It is the object of the invention to provide apparatus of the kind outlined which enables a web to be produced in a width exceeding the working width of the particular machine used, high working speeds being possible with low web weights.

According to the invention, in apparatus wherein the table for conveying the web extends at an angle to the operative direction of the machine, this problem is solved by deflectors which are associated with the take-off units and which, as considered in the operative direction of the machine, are spaced apart from one another by a distance corresponding to the width of the taken-off web, the deflectors extending at an angle to the operative direction of the machine, such angle corresponding to half the angle between the operative direction of the take-off table and that of the table for conveying the web.

Preferably, the angle between the operative direction of the take-off table and the conveying table is a right-angle and the angle between the operative direction of the take-off table and the deflector is 45°.

If, however, the working direction of the conveying table and the working direction of the machine are parallel to one another, the problem is solved by two deflectors associated with at least one of the take-off devices, such deflectors being disposed, as considered at right-angles to the operative direction of the machine, at a spacing from one another which corresponds to the width of the taken-off web, the deflectors extending at an angle of 45° to the latter direction and to the operative direction of the conveying table, the latter direction being parallel to the operative direction of the machine. If in this case the machine has three take-off units available, then preferably a first pair of deflectors are associated with a first take-off unit, a second pair of deflectors are associated with a second take-off unit and no deflectors are associated with a third take-off unit, the deflectors which are associated with the first take-off unit extending at right-angles to the deflectors which are associated with the second take-off unit.

Preferably, the deflectors take the form of rolls. The advantage of devising the deflectors as rolls is that friction between the web and the deflector is obviated.

The web is supplied to the deflectors by means of a number of belts or aprons which extend in the direction of movement; preferably, the belts are guided in grooves in a rotatably mounted shaft.

Also, the method according to the invention is distinguished by the taken-off webs being guided by way of mechanical or electrical control units ensuring overlapping or contiguity of the discrete webs.

Preferably, the contiguous and slightly overlapping webs are guided by means for combining the contiguous or slightly overlapping edges of the webs, the means for combining the edges possibly taking the form of a calender, more particularly a thermocalender.

Other features and advantages of the invention will become apparent from the claims, description and drawings wherein:

Figure 1:
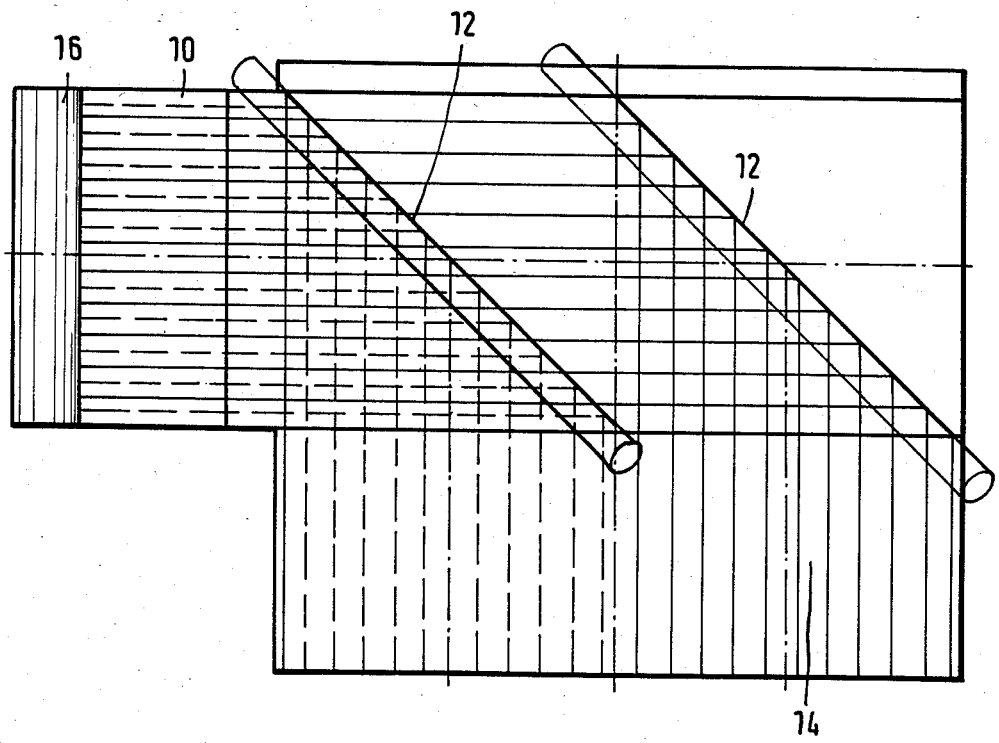
FIG. 1 is a diagrammatic plan view of the device according to the invention, the take-off being at right-angles to the operative direction of the machine.

FIG. 1 shows how a fibrous web supplied to a machine 16 and take-off tables 10 is supplied to deflectors 12. The same extend at an angle of 45° to the operative direction of the machine, so that the web is deflected at an angle of 90° to the operative direction of the machine. Since the deflectors 12 are spaced apart from one another by a distance which, as considered in the operative direction of the machine, corresponds to the width of one of the webs, the two webs produced by the machine are disposed on the textile-conveying table 14 one beside another to originate a new web of twice the width.

Figure 2:
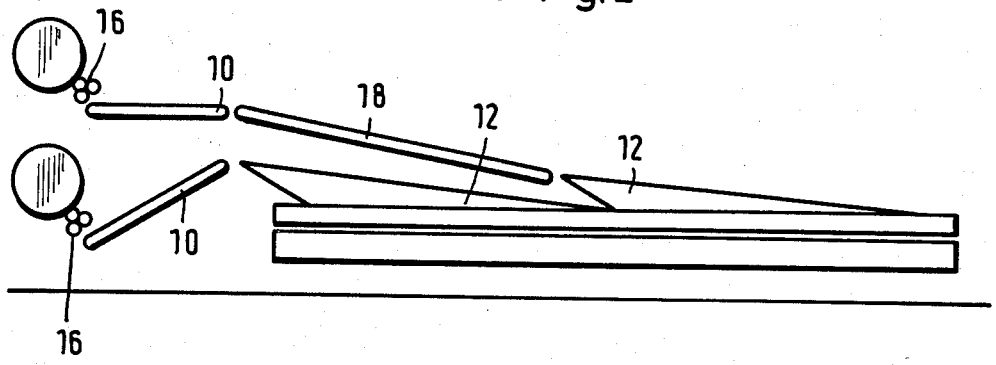
FIG. 2 is a diagrammatic view in cross-section of the device of FIG. 1.

FIG. 2 is a view in cross-section showing how the web produced by the bottom take-off unit of the machine is supplied to the first deflector near the machine 16, whereas the web produced by the top take-off unit is supplied to the machine 16 and table 10 by way of a conveyor belt 18 beyond the first deflector 12 to the more outwardly disposed second deflector 12. The same is disposed at an angle of 45° to the operative direction of the machine, with the result that the two webs are conveyed on the table 14 with their edges abutting one another or slightly overlapping one another.

Figure 4:
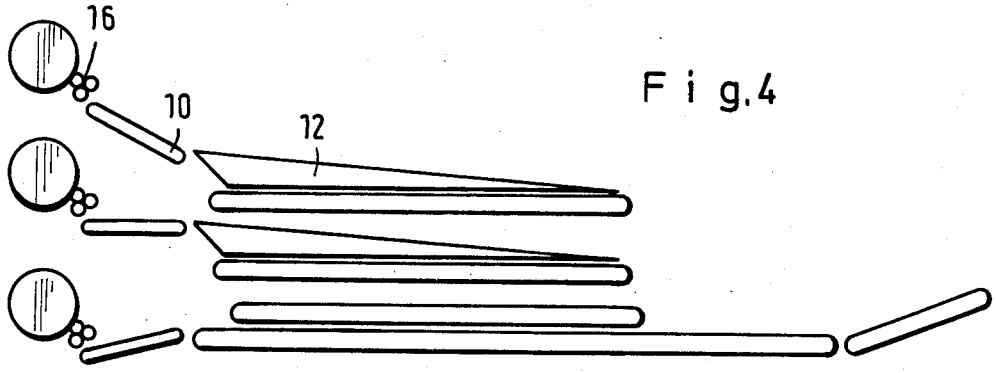
FIG. 4 is a diagrammatic cross-sectional view of the device shown in FIG. 3.
Figure 3:
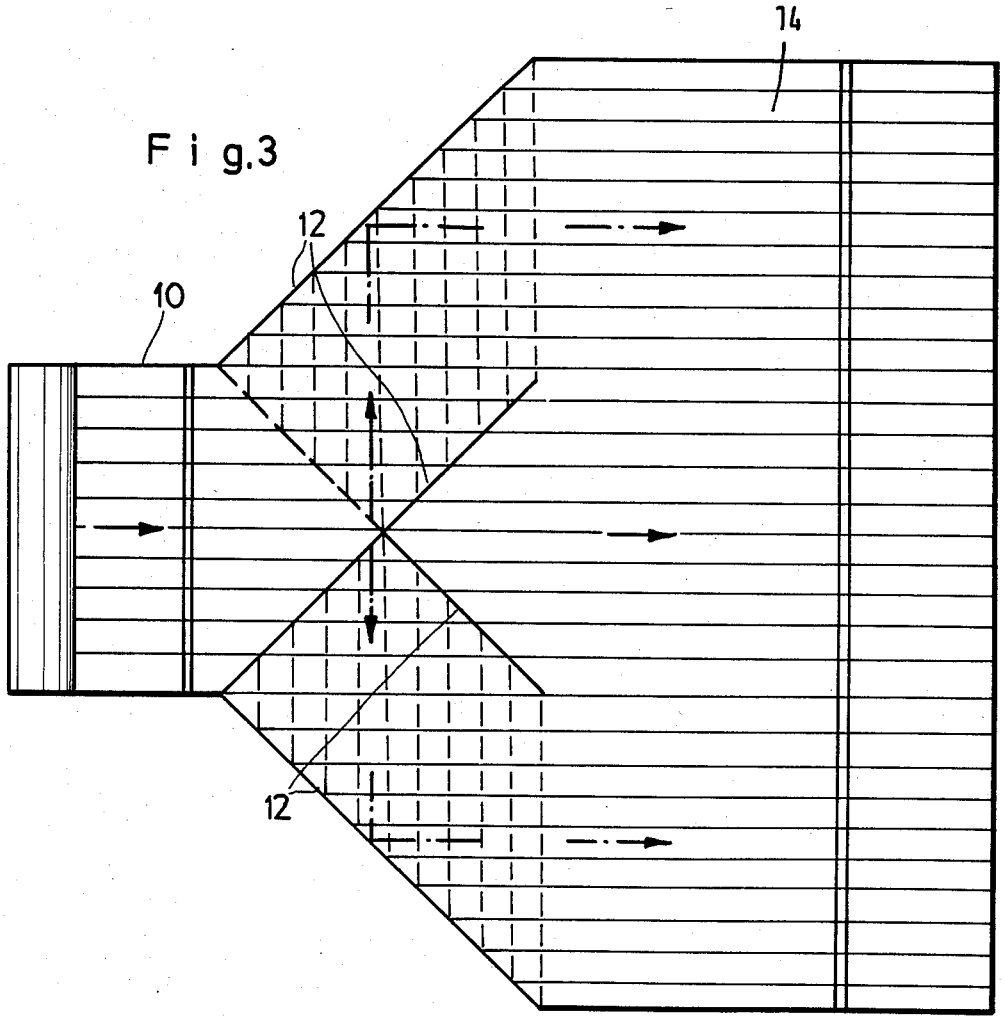
FIG. 3 is a diagrammatic plan view of the device according to the invention with take-off in the direction of the operative direction of the machine, two pairs of deflectors being provided.

An alternative system shown in FIGS. 3 and 4 differs from the foregoing in that the top take-off table or unit 10 it has two pairs of deflectors 12 disposed at an angle of 45° to the operative direction of the machine. The deflectors which, as considered transversely of the operative direction, are spaced apart from one another by a distance corresponding to the working width of the web removed from the machine, ensure that the two webs taken off by the machine are either directly contiguous with one another on the table 14—which in this case extends in the same direction as the operative direction of the machine—or have their edges disposed one above another in a slightly overlapping relationship. In this way three webs can be disposed one beside another.

Consequently, the device according to the invention enables the width of the web produced by a machine to be increased considerably at low cost. To hide the seam between the two contiguous webs, the resulting multiple-width web is, conveniently, given further treatment, more particularly by being treated by a calender (not shown). More particularly in the case of synthetics, a thermocalender can be used.

The contact zone between the adjacent or slightly overlapping webs must be accurately adjusted if it is not to be too thick or too thin.

The inventive features disclosed in the foregoing description, in the drawings and in the claims may be significant both individually and in any combination for embodying the invention in its various embodiments.

LIST OF REFERENCES

10 Take-off or removal table
12 Deflector
14 Table for conveying the web
16 Machine
18 Conveyor belt

We claim:

1. An apparatus for producing a web whose width exceeds a working width of a web portion being produced by a machine, particularly cards, carding machines and pneumatic web formers, said machine having a number of take-off units arranged in a stack and discharging the web portions in a first direction, said apparatus having a conveyor table for conveying the web in a second direction at a first angle from the first direction, each of the take-off units having a deflector extending at one-half of the first angle to both the first and second directions, said deflectors being positioned along the first direction at a spacing from each other equal to a width of the web portion so that the web portions are deflected into the second direction and placed side-by-side with edges contact on the conveyor table.

2. An apparatus according to claim 1, wherein the first angle between the first direction for the discharge of the take-off units and the second direction for the conveyor table is a right angle and the angle between each deflector and the first and second directions is 45°.

3. An apparatus according to claim 1, wherein each deflector has a form of a roll.

4. An apparatus for producing a web whose width exceeds the working width of a web portion being discharged from a machine such as a carding machine, said machine having a number of take-off units arranged in the stack and each discharging a web portion in a first direction, said apparatus having a conveyor table for conveying the web portions in the first direction, and at least one of the take-off units having a pair of parallel extending deflectors extending at right angles to the first direction, the deflectors of said pair having a spacing therebetween corresponding to the width of the take-off web portion so that the take-off web portion is offset one width and placed on said conveyor table alongside of an adjacent web portion from a unit free of deflectors.

5. An apparatus according to claim 4, wherein the machine has three take-off units and includes another pair of deflectors associated with one of the other take-off units, said other pair of deflectors extending parallel at an angle 45° to the first direction and at right angles to the deflectors of the first-mentioned pair with the spacing of the deflectors of the other pair being equal to the width of the web portion of the take-off unit so that the web portion of one take-off unit moves onto the conveyor table without deflection and the web portions on the other two take-off units are disposed adjacent the sides of the first-mentioned web portion to form a web having a width substantially three times the width of the web portion of a single unit.

6. Apparatus according to claim 4, wherein the deflectors (12) take the form of a roll.

7. An apparatus according to claim 4, wherein the web is supplied to the deflectors (12) by means of a number of belts or aprons which extend in the direction of movement.

* * * * *